United States Patent [19]

Belttary

[11] 4,032,875

[45] June 28, 1977

[54] CIRCUIT BREAKER

[75] Inventor: Harold E. Belttary, Rio Piedras, P.R.

[73] Assignee: Caribe Circuit Breaker Co., Inc., San Juan, P.R.

[22] Filed: May 27, 1976

[21] Appl. No.: 690,664

[52] U.S. Cl. ..... 337/70; 335/21; 335/43

[51] Int. Cl.[2] ..... H01H 73/24

[58] Field of Search ..... 337/70, 43; 335/21, 335/17, 22, 25, 42, 35, 167, 170, 173; 200/293, 67 PK

[56] References Cited

UNITED STATES PATENTS

| | | | |
|---|---|---|---|
| 2,426,680 | 9/1947 | Jackson et al. | 200/67 PK |
| 2,624,815 | 1/1953 | Gano | 335/17 |
| 2,627,564 | 2/1953 | Ericson | 200/67 PK |
| 3,089,933 | 5/1963 | Locher | 337/43 |
| 3,200,228 | 8/1965 | Locher | 200/293 |
| 3,244,835 | 4/1966 | Locher | 335/173 |

*Primary Examiner*—Harold Broome
*Attorney, Agent, or Firm*—David M. Keay; Elmer J. Nealon; Norman J. O'Malley

[57] ABSTRACT

Circuit breaker having a trip arm which is released during tripping of the breaker under overcurrent conditions. One end of a contact opening arm is pivotally mounted on the trip arm. When the trip arm is released, the trip arm also contacts the other end of the contact opening arm forcing it against the contact carrier which supports the movable contact thereby opening the contacts.

5 Claims, 3 Drawing Figures

CIRCUIT BREAKER

BACKGROUND OF THE INVENTION

This invention relates to circuit breakers. More particularly, it is concerned with low voltage circuit breakers for controlling low and moderate power electrical circuits.

A circuit breaker for use in controlling electrical circuits typically has a set of contacts, one fixed and one movable, and a toggle, or overcenter mechanism, which is manually operated to close and open the contacts. A circuit breaker also includes an overload mechanism for tripping the circuit breaker and opening the contacts automatically when the electrical current through the circuit breaker exceeds certain predetermined conditions.

Typically circuit breakers of this type include an overcenter spring which is connected between a movable contact arm carrying the movable contact and a trip arm which is held latched in a set position under normal operating conditions. The contact arm pivots about a pivot point which is shiftable by means of a manually-operated handle to place the pivot point on one side of the overcenter spring whereby the spring causes the contacts to be closed, or to place the pivot point on the other side of the overcenter spring whereby the spring causes the contacts to be open. Under overload conditions a current sensitive mechanism releases the latched trip arm and the overcenter spring moves the trip arm from the set to a tripped position. Movement of the trip arm to the tripped position shifts the position of the overcenter spring with respect to the pivot point and the force of the overcenter spring in this position causes the contacts to open.

In certain situations the action of the overcenter spring alone after the trip arm has been released may not be adequate to separate the contacts or to separate them as rapidly as might be desired. Various mechanisms have been employed for positively urging the contacts apart to supplement the action of the overcenter spring arrangement. Mechanisms for this purpose are disclosed in U.S. Pat. No. 2,624,815 to Gano et al, for example. The arrangement of the mechanical elements in various types of circuit breakers, however, precludes the use of mechanisms such as those shown in the patent to Gano et al for positively separating the contacts. An example of one such form of circuit breaker is described in U.S. Pat. Nos. 3,089,933, 3,200,228, and 3,244,835 to Locher. In this circuit breaker the configurations of the trip arm and movable contact arm, their paths of movement with respect to each other, and the arrangement of other elements precludes employing the mechanism of Gano et al to positively open the contacts upon tripping.

SUMMARY OF THE INVENTION

A circuit breaker in accordance with the present invention includes an improved arrangement for positively separating the contacts upon tripping. The circuit breaker includes a housing of insulating material, a fixed contact mounted in the housing, and an actuating means including a manually movable handle mounted in the housing. A contact carrier which has a movable contact mounted thereon pivotally engages the actuating means at a pivot point. A trip arm is pivotally mounted in the housing and a contact opening arm has one end pivotally mounted on the trip arm. An overcenter spring is connected between the contact carrier and the trip arm.

The actuating means, contact carrier, and overcenter spring form an overcenter arrangement which closes the contacts when the spring is on one side of the pivot point and which opens the contacts when the spring is on the other side of the pivot point. When the handle is placed in a first position, the pivot point is positioned with the spring on one side, and when the handle is placed in a second position, the pivot point is positioned with the spring on the other side.

An overcurrent latch mechanism engages the trip arm and maintains the trip arm in a set position with the spring urging the trip arm toward a tripped position when the contacts are closed. The overcurrent latch mechanism includes a current responsive member connected in circuit between the movable contact and a load terminal mounted in the housing. The overcurrent latch mechanism disengages the trip arm in response to a predetermined overcurrent condition thereby releasing the trip arm for movement to the tripped position. Movement of the trip arm to the tripped position moves the spring to the other side of the pivot point whereby the overcenter arrangement tends to cause the contacts to open. In addition the trip arm forces the other end of the contact opening arm against the contact carrier during movement of the trip arm to the tripped position to cause opening of the contacts.

BRIEF DESCRIPTION OF THE DRAWINGS

Additional objects, features, and advantages of circuit breakers in accordance with the present invention will be apparent from the following detailed discussion together with the accompanying drawings wherein.

DETAILED DESCRIPTION OF THE INVENTION

Figure 1:
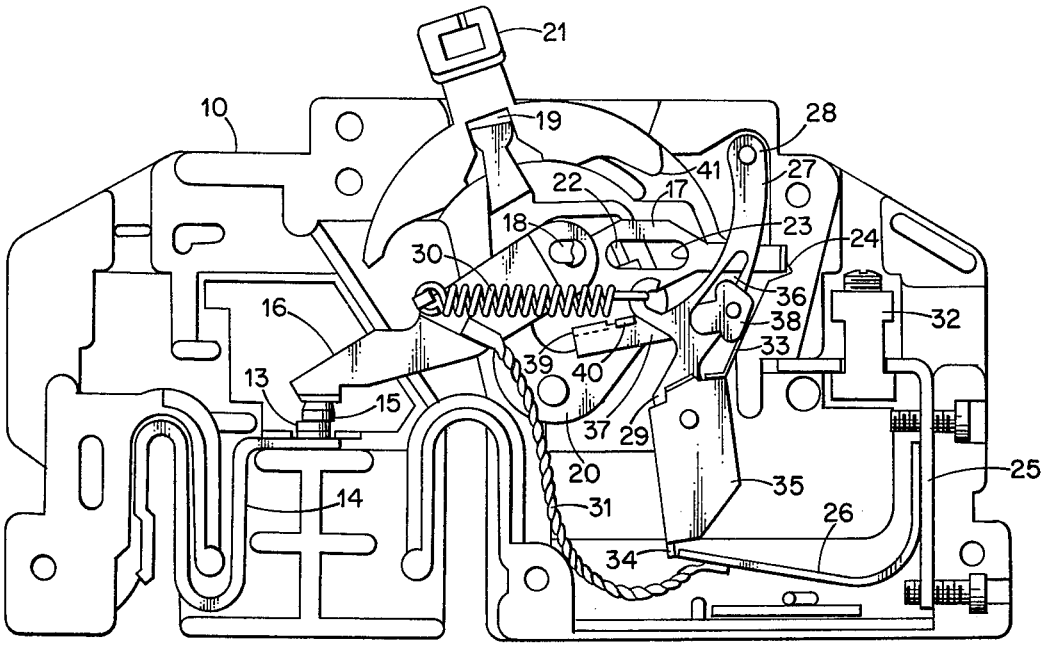
FIG. 1 is a side elevational view of a circuit breaker in accordance with the invention with the cover of the housing removed and showing the contacts in the closed position.

A circuit breaker in accordance with the present invention as illustrated in the figures includes a housing comprising a case 10 of a suitable insulating material and a cover 11 of similar material. The case and cover are typically of molded plastic. The various elements of the circuit breaker mechanism are mounted within the case 10 and held in place by the cover 11 which is riveted to the case.

A fixed contact 13 is mounted in the case on a bus clip 14 which is designed to engage a line bus when the breaker is inserted into a distribution panel box. A moving contact 15 is mounted on a contact arm 16. The contact arm 16 is connected to a pivot arm 17 at a pivot point 18 at one end of the contact arm. An actuator 20 is pivotally mounted at its lower end in the case and its upper end engages a notch 19 in a manually movable handle 21. A tab 22 on the actuator 20 engages the pivot arm 17 in an opening 23. The opposite end of the pivot arm 17 pivots in a recess 24 in the case.

A trip arm 27 is pivotally mounted at its upper end 28 in the case. Its lower end 29 engages a latch lever 35 which is pivotally mounted in the case. A thermal trip or thermostat member 26 is attached to a conductive bar 25 which is mounted to the case. The free end of the thermostat member 26 engages an extension 34 at the tip of the latch lever 35. The latch lever 35 is urged by a spring 33 to pivot in the counterclockwise direction but is held in latched position by the extension 34 abutting the end of the thermostat element 26. A flexible conductor 31 is connected between the contact carrier 16 and the thermostat element 26. A load terminal 32 for receiving an external wire is fixed to the conductive bar 25. A toggle or overcenter spring 30 is connected between the central portion of the contact arm 16 and the central portion of the trip arm 27.

Figure 3:
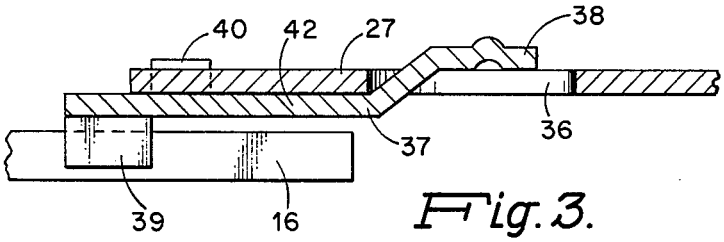
FIG. 3 is a detailed view of the contact opening arm and portions of other elements taken in cross-section along the line 3—3 of FIG. 2.

The central region of the trip arm 27 contains an opening 36 in which is positioned a contact opening arm 37. As best seen in FIG. 3 the contact opening arm has a planar central portion 42 which lies parallel to and between the planes of the trip arm 27 and contact arm 16. One end of the contact opening arm is bent so as to pass through the opening 36, and an enlarged portion 38 at the one end prevents the contact opening arm 37 from slipping out of the trip arm 27. One tab 39 at the other end of the contact opening arm extends into the plane of the contact carrier 16 and another tab 40 extends in the opposite direction into the plane of the trip arm 27.

The circuit breaker as described is shown in FIG. 1 with the contacts closed. The trip arm 27 is in a set position with its lower end 29 engaged by the latch lever 35. The latch lever 35 is held in position against the urging of the overcenter spring 30 by virtue of engaging the end of the thermostat element 26. The contacts may be opened manually by rotating the handle 21 in the clockwise direction. This action rotates the actuator 20 about the pivot at its lower end causing the tab 22 to pivot the pivot arm 17 in a counterclockwise direction about the recess 24. The pivot point 18 of the contact arm 16 and the pivot arm 17 is thereby moved to the opposite side of the overcenter spring 30. With the pivot point 18 and overcenter spring 30 in these positions, the force of the overcenter spring pivots the contact arm 16 in a clockwise direction opening the contacts. Under normal manual operation the contacts are reclosed by returning the handle 21 to the position shown in FIG. 1. The pivot point 18 is thereby shifted back to the other side of the overcenter spring 30 and the contact arm 16 pivots to close the contacts.

Figure 2:
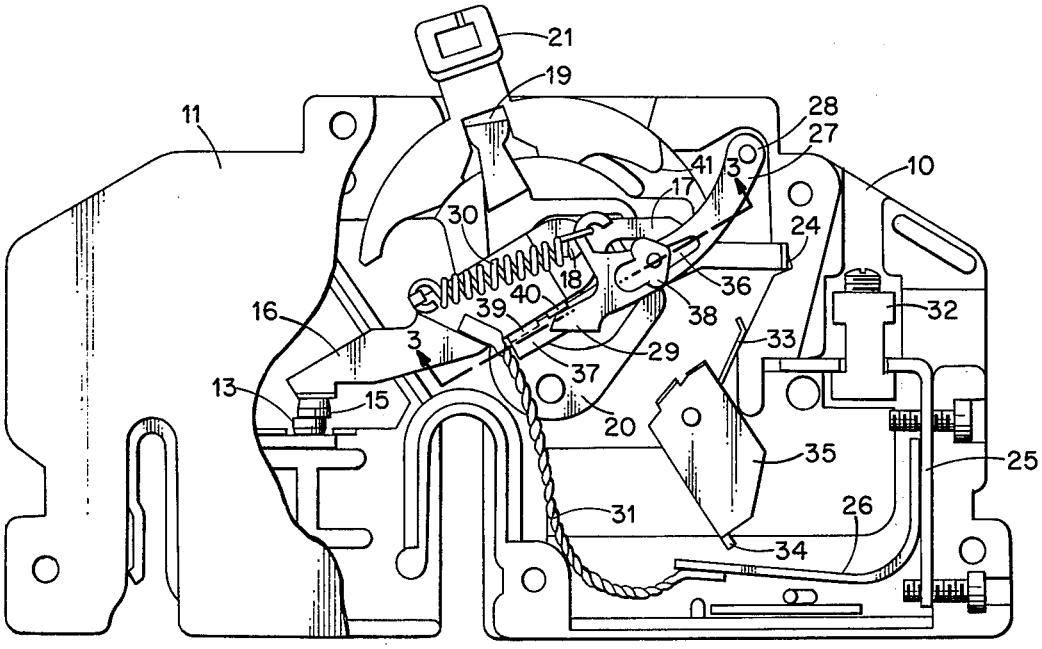
FIG. 2 is a view of the circuit breaker similar to the view of FIG. 1 having the cover in place with portions broken away to show the elements in a partially tripped position with the contacts still closed.

As is readily understood in the operation of circuit breakers, under predetermined overcurrent conditions the free end of the thermostat element 26 moves downward disengaging the extension 34 of the latch lever 35. The latch lever 35 is urged by the overcenter spring 30 acting on the trip arm 27 to rotate in the counterclockwise direction releasing the lower end 29 of the trip arm 27. The force of the overcenter spring 30 acting on the released trip arm 27 causes the trip arm to pivot in a clockwise direction about the pivot at its upper end 28. As the trip arm carrying the contact opening arm 37 rotates, the edge of its lower end 29 comes into contact with the tab 40 of the contact opening arm and tab 39 of the contact opening arm comes into contact with the edge of the contact arm 16 as shown in FIG. 2. When the moving end 29 of the trip arm 27 contacts the tab 40 and the tab 39 contacts the contact arm 16, the resulting sharp blow to the contact arm 16 at a point between the pivot point 18 and the contact 15 adds to the contact opening force exerted by the overcenter spring 30 and assists in separating the contacts. The movement of the trip arm 27 to the tripped position shifts the overcenter spring 30 above the pivot point 18, and the action of the overcenter spring rotates the contact arm 16 thereby completing the separating action and holding the contacts open.

The circuit breaker is reset from the tripped position in the usual well-known manner. The handle 21 is first rotated to the fully open or clockwise position rotating the actuator 20 and lowering the pivot point 18. The end 41 of the handle 21 forces the trip arm to pivot in the counterclockwise direction. The lower end 29 of the trip arm 27 contacts the latch lever 35, which has been held in its tripped position by spring 33, rotating it in the clockwise direction. The extension 34 of the latching lever 35 engages the free end of the thermostat element 26 thereby latching the trip arm 27 in the set position so that all the elements are restored to a normal open position. During this resetting movement the contact opening arm 37 pivots as necessary in the opening 36 in the trip arm 27 so as to avoid interfering with the lower end 29 of the trip arm 27 and the latch lever 35 and with the actuator 20. After the elements have been reset with the contacts open, the contacts may be restored to the closed position by the normal operation rotating the handle 21 to the counterclockwise position as shown in FIG. 1.

While there has been shown and described what is considered a preferred embodiment of the present invention, it will be obvious to those skilled in the art that various changes and modifications may be made therein without departing from the invention as defined in the appended claims.

What is claimed is:

1. A circuit breaker including in combination a housing of insulating material;

a fixed contact mounted in said housing;

actuating means including a manually movable handle mounted in said housing;

a contact carrier with a movable contact thereon, said contact carrier pivotally engaging said actuating means at a pivot point;

a trip arm pivotally mounted in said housing;

a contact opening arm having one end pivotally mounted on said trip arm;

an overcenter spring connected between said contact carrier and said trip arm;

said actuating means, contact carrier, and overcenter spring forming an overcenter arrangement for closing said contacts when the spring is on one side of said pivot point and for opening said contacts when the spring is on the other side of said pivot point;

said pivot point being in a position with the spring on the one side thereof when said handle is placed in a first position, and being in a position with the spring on the other side thereof when said handle is placed in a second position while said trip arm is in a set position;

an overcurrent latch mechanism engaging said trip arm and maintaining said trip arm in the set position with said spring urging said trip arm toward a tripped position when said contacts are closed; and a load terminal mounted in said housing;

said overcurrent latch mechanism including a current responsive member connected in circuit between the movable contact and the load terminal;

said overcurrent latch mechanism being operative to disengage said trip arm in response to a predetermined current condition in said current responsive member releasing said trip arm for movement to the tripped position;

movement of the trip arm to the tripped position moving the spring to the other side of said pivot point whereby said overcenter arrangement tends to cause said contacts to open;

said trip arm forcing the other end of said contact opening arm against the contact carrier during movement of the trip arm to the tripped position to cause opening of said contacts.

2. A circuit breaker in accordance with claim 1 wherein said other end of said contact opening arm is disengaged from the trip arm and from the contact carrier when said trip arm is in the set condition; and said trip arm moves into engagement with said other end of said contact opening arm and forces said other end against the contact carrier during movement of the trip arm from the set position to the tripped position thereby urging the contact carrier to pivot about said pivot point in a direction to open the contacts.

3. A circuit breaker in accordance with claim 2 wherein said trip arm is an elongated member pivotally mounted at one end in said housing;

the other end of said trip arm is operable to engage said overcurrent latch mechanism;

said spring engages said trip arm at a point intermediate the ends of the trip arm;

said contact opening arm is pivotally mounted on the trip arm at a point intermediate the ends of the trip arm; and said other end of the trip arm engages the other end of the contact opening arm during movement of the trip arm to the tripped position when released from said overcurrent latch mechanism, and urges said other end of the contact opening arm against the contact carrier in a region intermediate said pivot point and the movable contact.

4. A circuit breaker in accordance with claim 3 wherein said trip arm contains an opening in the region intermediate its ends; and the one end of said contact opening arm extends through said opening and includes an enlarged portion for holding said contact opening arm in the trip arm while permitting pivotal movement with respect thereto.

5. A circuit breaker in accordance with claim 4 wherein said contact carrier is substantially planar and moves in the plane in which it lies;

said trip arm is substantially planar and moves in the plane in which it lies, said plane being spaced from but close to and parallel with the plane of the contact carrier;

said contact opening arm has a planar central portion lying adjacent to the surface of the trip arm facing toward the contact carrier;

said contact opening arm has a first tab at said other end extending into the plane of the trip arm for intercepting the other end of the trip arm during movement of the trip arm from the set to the tripped position;

said contact opening arm has a second tab at said other end extending into the plane of the contact carrier for bearing against the contact carrier when the other end of the contact opening arm contacts the contact carrier during movement of the trip arm from the set to the tripped position;

the one end of said contact opening arm is bent out of the plane of the central portion and passes through said opening in the trip arm; and said enlarged portion at the one end of the contact opening arm lies adjacent to the surface of the trip arm facing away from the contact carrier.

* * * * *